US006454361B1

(12) United States Patent
Martin

(10) Patent No.: US 6,454,361 B1
(45) Date of Patent: Sep. 24, 2002

(54) SKATEBOARD WHEEL COVER RIM

(76) Inventor: Desmond G. Martin, 14161 Raleigh Pl., Tustin, CA (US) 92780

( * ) Notice: Subject to any disclaimer, the term of this patent is extended or adjusted under 35 U.S.C. 154(b) by 0 days.

(21) Appl. No.: 09/845,067

(22) Filed: Apr. 30, 2001

(51) Int. Cl.[7] ..... A63C 17/22
(52) U.S. Cl. ..... 301/5.301; 301/37.22
(58) Field of Search ..... 301/5.301, 5.7, 301/5.305, 37.101, 37.22, 37.23, 37.34, 37.42; D21/763

(56) References Cited

U.S. PATENT DOCUMENTS

| | | | | | |
|---|---|---|---|---|---|
| 1,968,076 | A | * | 7/1934 | Goodyear et al. | 301/37.22 |
| 2,241,686 | A | * | 5/1941 | Ware | 301/5.3 |
| 2,432,105 | A | * | 12/1947 | Wagner | 301/37.22 |
| 2,580,489 | A | * | 1/1952 | Wagner | 301/37.22 |
| 2,606,791 | A | * | 8/1952 | Specht | 301/5.3 |
| 2,610,897 | A | * | 9/1952 | Rebmann | 301/5.3 |
| 3,302,954 | A | * | 2/1967 | Elwell | 301/5.3 |
| 3,602,150 | A | * | 8/1971 | Frost | 301/5.7 |
| 3,860,293 | A | | 1/1975 | Labeda | |
| 3,992,025 | A | | 11/1976 | Amelio | |
| 4,128,254 | A | | 12/1978 | Powell | |
| 4,218,098 | A | | 8/1980 | Burton | |
| 4,962,968 | A | | 10/1990 | Caplin | |
| 5,058,959 | A | * | 10/1991 | Miles et al. | 301/5.3 |
| D355,464 | S | | 2/1995 | Wilson et al. | |
| D398,691 | S | | 9/1998 | Bromley | |
| D398,692 | S | | 9/1998 | Wilson et al. | |
| 5,825,634 | A | | 10/1998 | Pozzobon | |
| 5,957,541 | A | * | 9/1999 | Seigler | 301/5.3 |
| 6,257,675 | B1 | * | 7/2001 | Leynaert | 301/37.23 |
| 6,336,685 | B1 | * | 1/2002 | Orr | 301/37.101 |

* cited by examiner

*Primary Examiner*—S. Joseph Morano
*Assistant Examiner*—Long Bao Nguyen
(74) *Attorney, Agent, or Firm*—Gordon K. Anderson

(57) ABSTRACT

A skateboard wheel (40) having bearings (42) pressed on each side is covered to enhance the appearance of the wheel. The wheel thermoplastic tire (46) includes a concentric circular recessed cavity (58) within its outer side wall (54) and a wheel cover rim (60) is disposed within this recessed cavity. The wheel cover rim has a central opening (62) of a diameter large enough to permit bearing removal and attachment means secure the wheel cover rim to the tire. The wheel cover rim defines its purpose by including a decorative design on its exposed surface to embellish the overall presentation of the wheel.

18 Claims, 4 Drawing Sheets

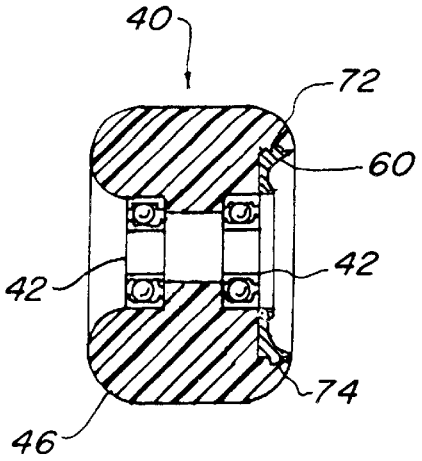
FIG. 31
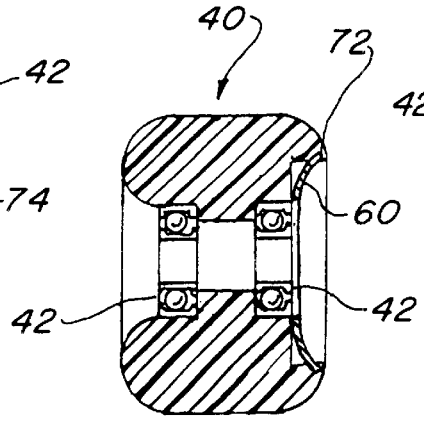
FIG. 32
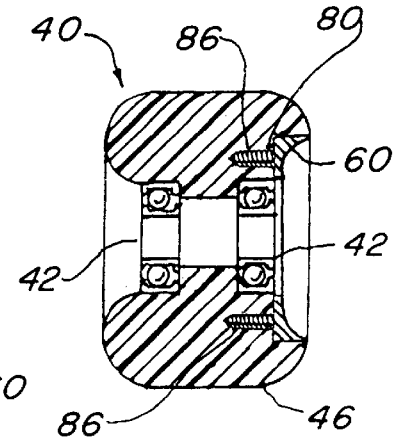
FIG. 33
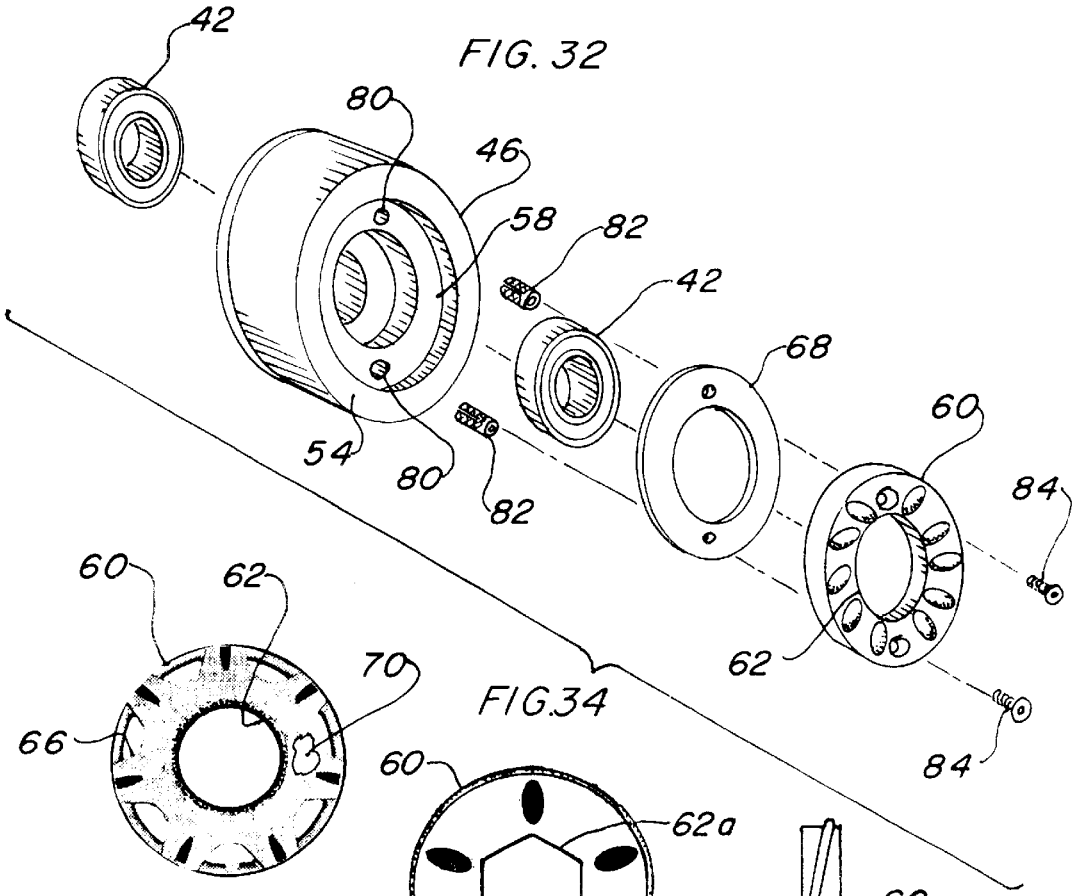
FIG.34
FIG. 35
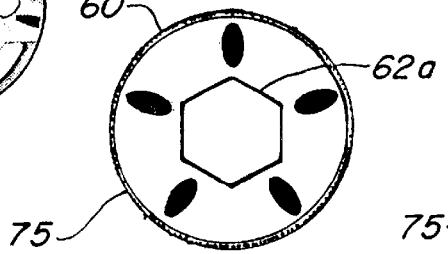
FIG. 36
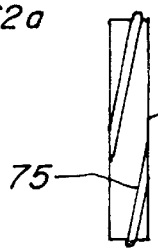
FIG. 37

SKATEBOARD WHEEL COVER RIM

TECHNICAL FIELD

The present invention relates to wheels for skateboards in general. More specifically to a wheel cover that is disposed within a cavity in a wheel for decorative purposes.

BACKGROUND ART

Previously, many types of wheels that include a decorative design around their side wall have been used in endeavoring to increase the cosmetic qualities of the wheel. The usual approach of prior art is to incorporate the design into the wheel itself which accomplishes the purpose however none have presented a detachable wheel cover rim that may be replaced or substituted.

A search of the prior art did not disclose any patents that possess the novelty of the instant invention, however the following U.S. patents are considered related:

| Patent Number | Inventor | Issue Date |
|---|---|---|
| 5,825,634 | Pozzobon | Oct. 20, 1998 |
| 4,962,968 | Caplin | Oct. 16, 1990 |
| 4,218,089 | Burton | Aug. 19, 1980 |
| 4,128,254 | Powell | Dec. 5, 1978 |
| 3,992,025 | Amelio | Nov. 16, 1976 |
| 3,860,293 | Labeda | Jan. 14, 1975 |
| Des. 398,692 | Wilson et al. | Sep. 22, 1998 |
| Des. 398,691 | Bromley | Sep. 22, 1998 |
| Des. 355,464 | Wilson et al. | Feb. 14, 1995 |

Pozzobon in U.S. Pat. No. 5,825,634 teaches a skateboard or roller-skate wheel that has a central hub with radial spokes and a tire which is connected to the hub. The hub has wings arranged in the interspace and are arranged to partially fill the spaces such that empty spaces are arranged directly adjacent to the spokes. The wings have a different rigidity than the outer portion of the tire.

Burton's U.S. Pat. No. 4,218,098 is for a hub of a skate wheel supported on an axle with bearings. The hub is flanged and has a tongue and groove connection with the tire to hold the tire in place and to distribute the stresses therebetween. The tire is removable and supported on the hub for replacement. Some embodiments have three bearings to support the hub on the wheel spindle.

Caplin in U.S. Pat. No. 4,962,968 discloses a skateboard hubcap which enhances the appearance of the skateboard by concealing the axle nut and bearings. The hubcap comprises a shield that is held in place with detents on the inner flat surfaces of a cylindrical extension to secure the hubcap in place. A spacer behind the nut assures adequate clearance for the detents to lock into the axle nut.

U.S. Pat. No. 4,128,254 issued to Powell is for skateboard wheels that have a circular cylindrical tread surface where the axially inner edge and the axially outer edge of the cylindrical tread surface have a radius of from one eight to one half of an inch. The presence of this radius at both the inner and outer edge of the tread surface allows the skateboard to safely negotiate turns and uneven surfaces.

Amelioin U.S. Pat. No. 3,992,025 discloses a skateboard wheel that has a roller body consisting of a solid piece of resilient plastic formed with cooling bores passing therethrough. At one end region, the roller body is formed with an enlarged recess with which the cooling bores communicate. In this recess the roller body has reinforcing fins integral with the roller body situated in places which contain the axis of the roller body and distributed about this axis.

Labeda in U.S. Pat. No. 3,860,293 teaches a skate wheel that has a rim or tire made of wood and a metallic hub where the outer races of ball bearings are mounted. The metallic hub has a cylindrical outer surface with axially aligned grooves and edges formed at one end and circumferential grooves axially spaced and an internal taper at the other end. Epoxy glue is applied onto the hub and into the tire and press fitted into the wood tire. When the glue is set the wheel is turned to assure roundness and is then balanced.

Design Pat. No. Des. 398,692 issued to Wilson et al. is for a skateboard wheel with treads.

Design Pat. No. Des. 398,691 of Bromley is for a wheel hub having cut-out sections positioned in a repetitive arrangement.

Design Pat. No. Des. 355,464 issued to Wilson et al. illustrates a skateboard wheel and tire with treads on the tire and spokes between the hub and tire.

DISCLOSURE OF THE INVENTION

Skateboards have been popular for decades and have attracted interest to all ages particularly the younger generations. As time goes by the skateboards have become more sophisticated and improved from a technical aspect. Basically a skateboard is simply a board or platform on which a person stands while rollers underneath support the platform permitting the board to travel holding the operators weight while being propelled by pushing off with one foot and leaving the other on the board. As such skateboards form a source of considerable pride and pleasure to the user while at the same time being a device for a sporting activity which requires considerable physical skill and agility. The art of skateboard riding has been so popular that physical facilities have been developed in some parts of this country called skateboard parks which include such structure as ramps, rails, pools, pyramids, grinding curbs etc. It may be clearly seen that there is an abundant amount of pride in the appearance of the skateboard and therefore it is a primary object of the invention to add a wheel cover rim to each skateboard wheel. Automobile wheels have the same attraction and many cars on the road today have wheels or at least wheel covers that are not standard original equipment but instead have been added by the owner of the vehicle for the single purpose of enhancing its appearance. By adding a wheel cover to conventional skateboard wheels the entire skateboard takes on an entirely different look that is distinct from that of the original manufacturer.

An important object of the invention is the fact that skateboard wheels are easily replaced by simply removing the nut attached to the axle and manually dislodging the wheel including the bearings. A substitute wheel containing the wheel cover may then readily replace the standard wheel by reversing the procedure.

Another object of the invention is that each skateboard may be personalized easily by replacing the wheels which permits an individual to select the type of style that best suits his or her character as a myriad of styles shapes, colors and textures are obtainable.

Still another object of the invention permits a variety of wheel covers to be selected and changed even after the original wheel has been purchased and in use. This interchangeability is important as wheels wear out and styles change allowing new designs to be produced. Individual wheel covers may also be changed without replacing the entire wheel in the configurations that utilize threaded fasteners etc. for attachment purposes.

Yet another object of the invention permits the use of optional back-up plates of various colors and finishes to be positioned between the wheel cover rim and the wheel being visible through the spokes or holes in the cover rim creating an entirely different overall appearance by the use of relatively inexpensive material. Further exotic finishes such as infractionary gratings that change color in the light at various angles of view and metallic colors add to the possible combinations available.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 31 is a cross sectional view taken along an arbitrary centerline illustrating a first alternate method of attachment of the wheel cover rim to the wheel tire.

FIG. 32 is a cross sectional view taken along an arbitrary centerline illustrating a second alternate method of attachment of the wheel cover rim to the wheel tire.

FIG. 33 is a cross sectional view taken along an arbitrary centerline illustrating a third alternate method of attachment of the wheel cover rim to the wheel tire.

FIG. 34 is a partial isometric exploded view of the preferred embodiment.

FIG. 35 is a partially cut away front view of a typical wheel cover rim held in place in the tire with adhesive.

FIG. 36 is a plan view of an embodiment with threads on the outside diameter of the wheel cover rim for attachment to the tire.

FIG. 37 is a end view of the embodiment with threads as shown in FIG. 36.

BEST MODE FOR CARRYING OUT THE INVENTION

Figure 1:
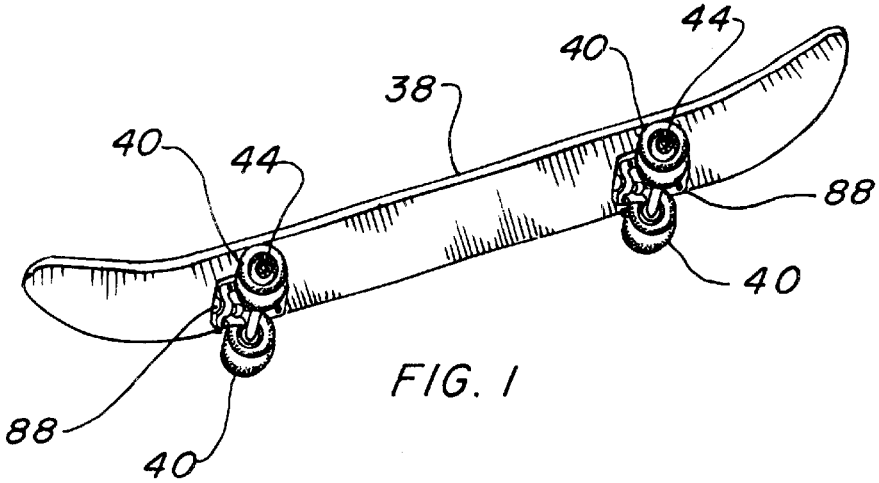
FIG. 1 is a partial isometric view of the preferred embodiment wheels installed on a skateboard.
Figure 2:
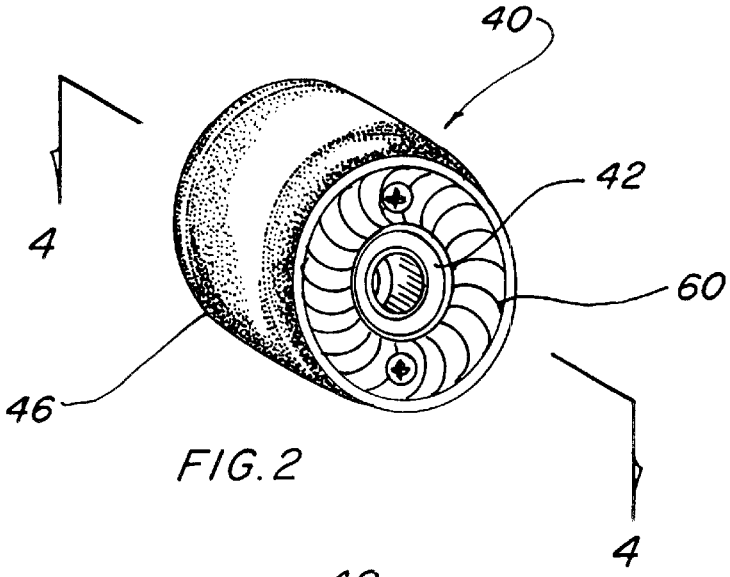
FIG. 2 is a partial isometric view of the preferred embodiment wheel cover rim assembled on a wheel that includes the bearings and the preferred means for attaching.
Figure 3:
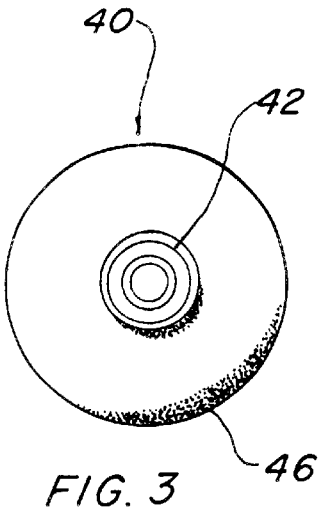
FIG. 3 is a side view of the preferred embodiment as it would be installed on the inside of the skateboard.
Figure 4:
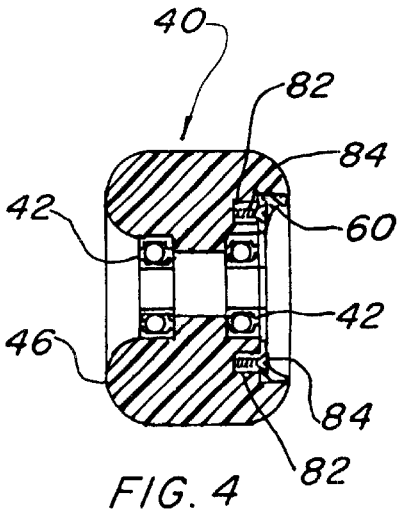
FIG. 4 is a cross sectional view taken along lines 4—4 of FIG. 2.
Figure 5:
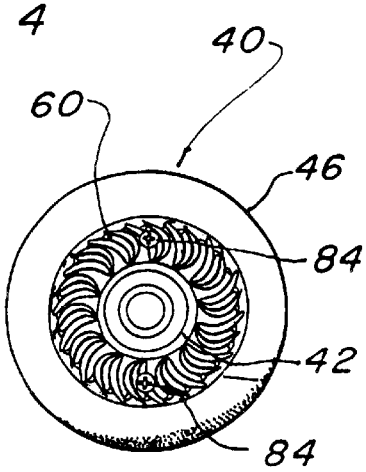
FIG. 5 is a side view of the preferred embodiment as it would be installed on the outside of the skateboard.

The best mode for carrying out the invention is presented in terms of a preferred embodiment. This preferred embodiment is shown in FIGS. 1 thorough 37 and is comprised of a skateboard wheel 40 for a skateboard 38 that includes a pair of bearings 42 mounted on an axle 44 that are pressed into each side of the wheel in the center as illustrated in FIGS. 2–5. The invention modifies a conventional skateboard wheel to include a wheel cover to enhance the appearance of the wheel.

Figure 6:
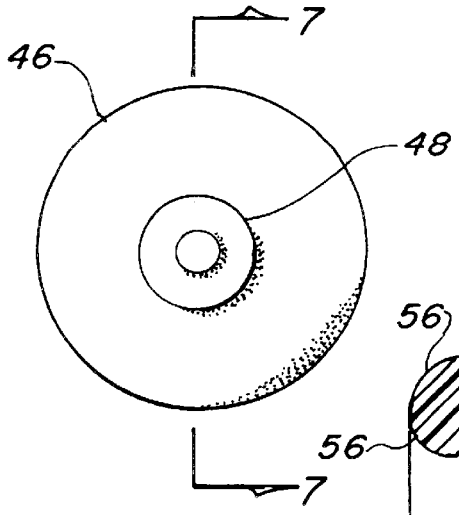
FIG. 6 is a side view of the wheel separated from the assembly as it would be installed on the inside of the skateboard.
Figure 8:
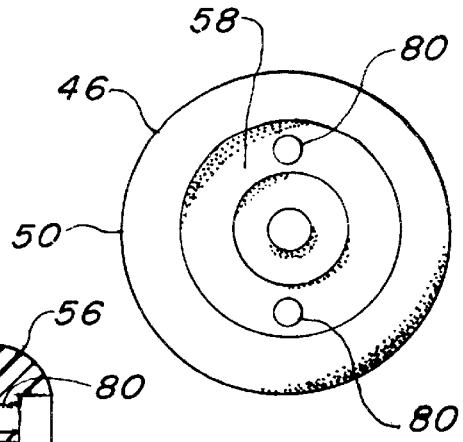
FIG. 8 is a side view of the wheel separated from the assembly as it would be installed on the outside of the skateboard.
Figure 7:
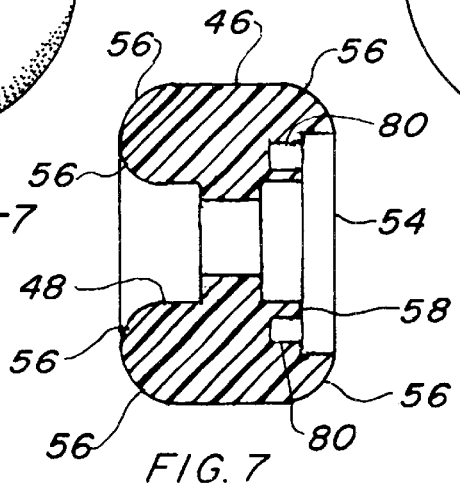
FIG. 7 is a cross sectional view taken along lines 7—7 of FIG. 6.
Figure 9:
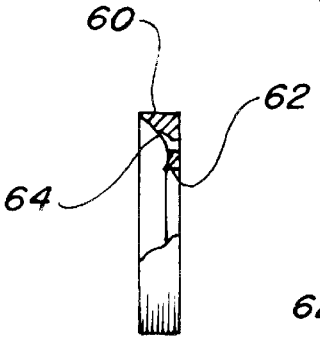
FIG. 9 is a left side cutaway view of the wheel cover rim removed from the invention for clarity.
Figure 10:
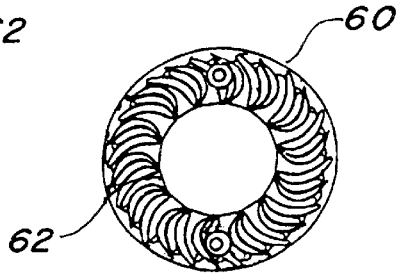
FIG. 10 is a front view of the wheel cover rim removed from the invention for clarity.
Figure 11:
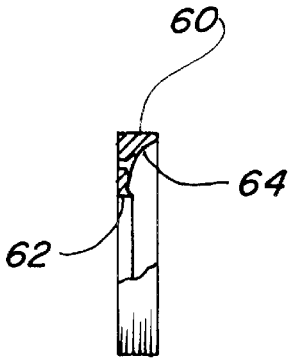
FIG. 11 is a right side cutaway view of the wheel cover rim removed from the invention for clarity.

The wheel 40 consists of a thermoplastic tire 46 for a skateboard having an inside diameter 48, an outside diameter 50, a inner side wall 52 and a outer side wall 54 as shown by itself in FIGS. 6–8. The thermoplastic tire 46 is preferably formed of polyurethane and includes a radius 56 on all outside diameter 50 distal edges in contact with a surface upon which the wheel operates exposed to the outer side wall 52, and a similar radius 56 on all inside diameters 48 exposed to the inner side wall 54. The tire 46 has a concentric circular recessed cavity 58 within its outer side wall 54 that is either molded in during manufacture or machined in a separate procedure after the molding process. The concentric circular recessed cavity 58 is parallel with and at right angles to the tire side wall as illustrated in FIG. 7 and has a depth slightly less than the thickness of a conventional skateboard bearing.

A wheel cover rim 60 is disposed within the recessed cavity 58 and includes a central opening 62 therein of a diameter large enough to permit bearing 42 removal. The wheel cover rim 60 contains a decorative design on the surface that is exposed to the outside and visible. Preferably, but not mandatory, the wheel cover rim 60 has a concave outer face 64 that is integral with the decorative design and could easily include spokes 66 as shown in FIGS. 17–20 and 35. It will be noted that the design on the exposed surface of the wheel cover rim is not to be limited to that illustrated as the value and advantage of the invention permits a variety of ornamental configurations to be utilized. FIGS. 2, 5, 10, 17–20 and 35 depict just a few possibilities of design formations as the combination of shapes and styles is obviously unlimited.

The wheel cover rim 60 may be constructed of a cast metal selected from a group consisting of aluminum, zinc alloy, steel and brass or fabricated of an injected molded thermoplastic selected from a group consisting of ABS nylon, polycarbonate, acetal, polyester, polyethylene, polystyrene, polyurethane and polyvinylchloride. It is easy to visualize that the material for the wheel cover rim 60 has many possibilities all functioning equally well in the application. If the wheel cover rim 60 is metal, the outside surface may be painted, plated or anodized and if it is injected molded thermoplastic the outside surface may be painted or easily metalized to enhance its appearance.

While not necessary a colorized back up-plate 68, as shown in FIG. 34, may be optionally disposed between the tire recessed cavity 58 and the wheel cover rim 60 visible between the spokes 66 for enhanced decorative purposes. A wide variety of colors and textures may be used for the up-plate 68 including metallic finishes, metal flakes, printed designs and the like.

Attachment means for securing the wheel cover rim 60 to the tire 46 are provided. If the wheel cover rim 60 is not required to be removed, an adhesive 70 may be used that is compatible with the materials of the tire 46 and the rim 60 which are well known in the art and in common usage in today's market. Another type of attachment means for securing the wheel cover rim 60 to the tire 46 is shown in FIG. 31 wherein the concentric circular recessed cavity 58 includes a circumferential groove 72 and the wheel cover rim 60 has a bead 74 distending outwardly permitting the rim 60 to snap into the groove 72 therefore retaining the rim 60 by the outward urging of the bead 74 into the groove 72. FIG. 32 illustrates another method of attachment when the rim 60 is made of stamped metal and is convex in shape, a similar groove 72 is formed into the recessed cavity 58 and the stamped metal rim 60 is forced into the groove 72 deflecting its shape until it snaps into place as shown.

Figure 22:
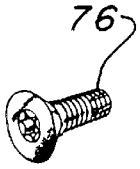
FIG. 22 is a partial isometric view of a flat head TORX self threading screw for attaching the wheel cover rim to the wheel tire.
Figure 30:
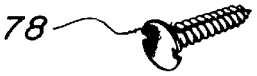
FIG. 30 is a partial isometric view of a pan head notched sheet metal screw for attaching the wheel cover rim to the wheel tire.

Removable attachment means for securing the wheel cover rim 60 to the tire 46 may utilize a plurality of self tapping screws 76 or sheet metal screws 78 as shown in FIGS. 22 and 27–30. The tire recessed cavity 58 requires a plurality of pilot holes 80 in which the self thread cutting screws are rotatably inserted. As an example of the possibilities FIG. 22 illustrates a flat head TORX self threading screw 76, FIG. 27 a button head TORX sheet metal screw 78, FIG. 28 a pan head tri-wing sheet metal screw 78, FIG. 29 a pan head square drive sheet metal screw 78 and finally FIG. 30 depicts a pan head notched sheet metal screw 78 for attaching the wheel cover rim 60 to the wheel tire 46.

Figure 12:
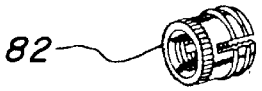
FIG. 12 is a partial isometric view of one embodiment of the means for attaching the wheel cover rim to the wheel in the form of a finned threaded insert.
Figure 13:
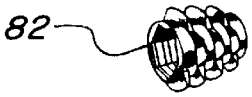
FIG. 13 is a partial isometric view of one embodiment of the means for attaching the wheel cover rim to the wheel in the form of a hex drive insert.
Figure 14:
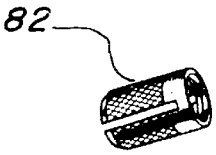
FIG. 14 is a partial isometric view of one embodiment of the means for attaching the wheel cover rim to the wheel in the form of a diamond knurled press insert.
Figure 15:
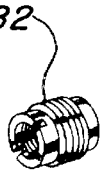
FIG. 15 is a partial isometric view of one embodiment of the means for attaching the wheel cover rim to the wheel in the form of a threaded insert.
Figure 16:
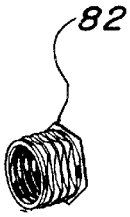
FIG. 16 is a partial isometric view of one embodiment of the means for attaching the wheel cover rim to the wheel in the form of a hex shaped press-in insert.
Figure 17:
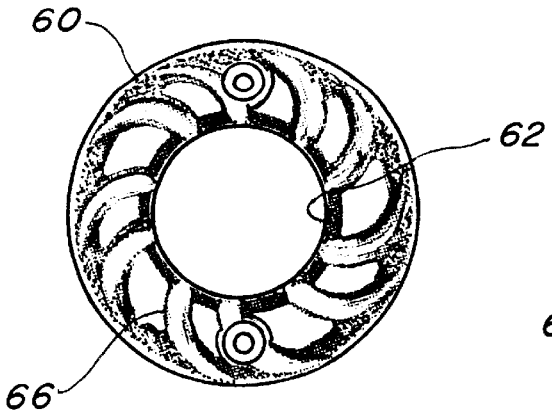
FIG. 17 is a front view of a first ornamental decorative design integral with the wheel cover rim.
Figure 18:
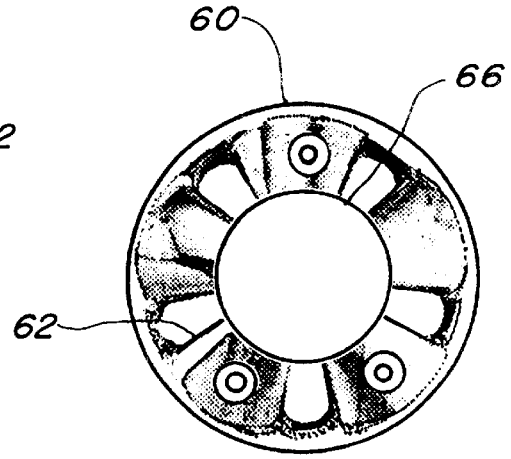
FIG. 18 is a front view of a second ornamental decorative design integral with the wheel cover rim.
Figure 19:
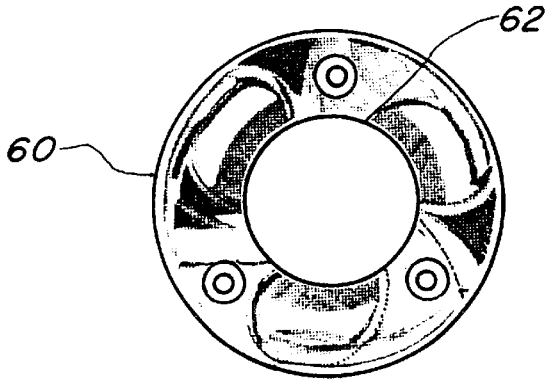
FIG. 19 is a front view of a third ornamental decorative design integral with the wheel cover rim.
Figure 20:
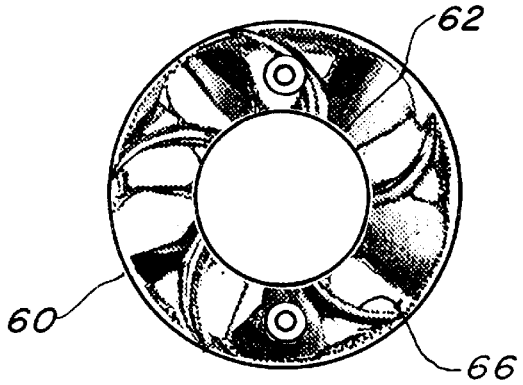
FIG. 20 is a front view of a fourth ornamental decorative design integral with the wheel cover rim.

Another removable attachment means for securing the wheel cover rim 60 to the tire 46 includes a plurality of threaded inserts 82 pressed into pilot holes 80 in the recessed cavity 58 of the tire 46 with a plurality of mating machine screws 84 threaded into the inserts 82. The threaded inserts 82 may be a variety of types or styles such as shown by example in the following figures; FIG. 12 is a finned threaded insert, FIG. 13 is a hex drive insert, FIG. 14 is a diamond knurled press insert, FIG. 15 is a threaded insert, and FIG. 16 is a hex shaped press-in insert.

Figure 21:
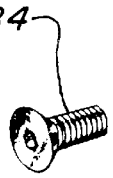
FIG. 21 is a partial isometric view of a flat head socket screw for attaching the wheel cover rim to the wheel tire.
Figure 23:
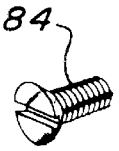
FIG. 23 is a partial isometric view of a flat head slotted screw for attaching the wheel cover rim to the wheel tire.
Figure 24:
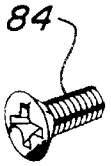
FIG. 24 is a partial isometric view of a flat head Phillips screw for attaching the wheel cover rim to the wheel tire.
Figure 25:
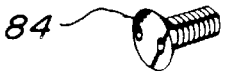
FIG. 25 is a partial isometric view of a flat head drilled head spanner screw for attaching the wheel cover rim to the wheel tire.
Figure 26:
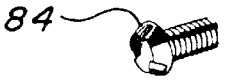
FIG. 26 is a partial isometric view of a tri-groove security screw for attaching the wheel cover rim to the wheel tire.
Figure 27:
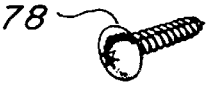
FIG. 27 is a partial isometric view of a button head TORX sheet metal screw for attaching the wheel cover rim to the wheel tire.
Figure 28:
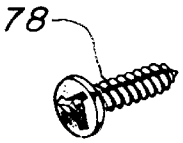
FIG. 28 is a partial isometric view of a pan head tri-wing sheet metal screw for attaching the wheel cover rim to the-wheel tire.
Figure 29:
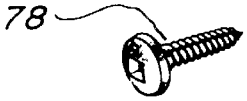
FIG. 29 is a partial isometric view of a pan head square drive sheet metal screw for attaching the wheel cover rim to the wheel tire.

Any type of head may be used for the machine screw 84 that may influence the appearance of the design and a few are shown in the following illustrations. FIG. 21 shows a flat head socket screw, FIG. 23 a flat head slotted screw, FIG. 24 a flat head Phillips screw, FIG. 25 a flat head drilled head spanner screw and FIG. 26 a tri-groove security screw for attaching the wheel cover rim 60 to the wheel tire 46 to illustrate a few.

Yet another removable attachment means for securing the wheel cover rim 60 to the tire 46 is illustrated in FIGS. 36 and 37. This approach incorporates male threads 75 on the outside diameter of the rim 60 that mate with a groove 72 molded or machined into the horizontal edge of the recessed cavity 58, as illustrated in another embodiment in FIG. 31. It should be realized that the groove 72, as illustrated is completely circumferential however in the threaded embodiment the groove is basically the same except it is angled to mate with the same pitch as the male threads 75. In order to install and easily remove the wheel cover rim 60 the central opening is hexagonal shape 62*a* as illustrated in FIG. 36 and a tool in the opposite configuration is inserted in the opening and rotated. A tool of this type is well known and in use today.

A final example of the attachment means for securing the wheel cover rim to the tire is illustrated in FIG. 33 wherein the wheel cover rim 60 has a plurality of integral studs 86 and the tire includes the necessary pilot holes 80 for mating with the studs 86 when the rim 60 is pressed into the recessed cavity 58 with the studs 86 interfacing with the pilot holes 80 in a gripping manner.

There has been many examples given above as to the method used in the attachment means however it should not be restricted to just those techniques as there are countless methods that are possible, such as barbed nails driven into pilot holes 80 in the tire through clearance holes in the rim 60, spring loaded balls disposed in bores parallel with the outer face 64 interfacing with the circumferential groove 72 in the cavity 58 and many others to numerous to mention.

The invention may be used on any skateboard 38 and the wheels 40 normally fit any axles 44 attached to conventional trucks 88, although the invention has been described in complete detail and pictorially shown in the accompanying drawings, it is not to be limited to such details, since many changes and modifications may be made to the invention without departing from the spirit and scope thereof Hence, it is described to cover any and all modifications and forms which may come within the language and scope of the appended claims.

SKATEBOARD WHEEL COVER RIM

Element Designation (For convenience of the Examiner, not part of the specification)

38 skateboard 40 wheel 42 bearing

44 axle
46 tire
48 tire inside diameter
50 tire outside diameter
52 tire inner side wall
54 tire outer side wall
56 tire radius
58 recessed cavity
60 wheel cover rim
62 central opening (in 60)
62*a* hexagonal central opening (in 60)
64 concave outer face (of 60)
66 spokes
68 back-up plate
70 adhesive
72 circumferential groove
74 bead (on 60)
75 male thread (on 60)
76 self tapping screw
78 sheet metal screw
80 pilot hole
82 insert
84 machine screw
86 stud (in FIG. 33)
88 skateboard truck

What is claimed is:

1. A skateboard wheel, having bearings pressed centrally therein, covered to enhance the appearance of the wheel, comprising:

a thermoplastic tire for a skateboard having an inside diameter, an outside diameter, a inner side wall and a outer side wall, wherein said tire having a concentric circular recessed cavity within the outer side wall, a wheel cover rim disposed within said recessed cavity, said wheel cover rim having a central opening therein of a diameter large enough to permit bearing removal, further said wheel cover rim including a decorative design on a surface that is exposed, and attachment means for securing the wheel cover rim to the tire.

2. The skateboard wheel as recited in claim 1 wherein said thermoplastic tire is formed of polyurethane.

3. The skateboard wheel as recited in claim 1 wherein said thermoplastic tire further comprises a radius on all outside diameter distal edges in contact with a surface upon which the wheel operates, exposed to the outer side wall and a radius on all inside diameters exposed to the inner side wall.

4. The skateboard wheel as recited in claim 1 wherein said concentric circular recessed cavity is parallel with the tire side wall.

5. The skateboard wheel as recited in claim 1 wherein said concentric circular recessed cavity further comprises a right angle recess relative to the tire side wall.

6. The skateboard wheel as recited in claim 1 wherein said wheel cover rim further having a concave outer face that is integral with the decorative design.

7. The skateboard wheel as recited in claim 1 wherein said wheel cover rim decorative design includes spokes.

8. The skateboard wheel as recited in claim 7 wherein said wheel cover rim further comprising a colorized back up plate disposed between the tire and the rim visible between the spokes for enhanced decorative purposes.

9. The skateboard wheel as recited in claim 1 wherein said wheel cover rim is constructed of a cast metal selected from a group consisting of aluminum, zinc alloy, steel and brass.

10. The skateboard wheel as recited in claim 1 wherein said wheel cover rim is constructed of an injected molded thermoplastic selected from a group consisting of ABS nylon, polycarbonate, acetal, polyester, polyethylene, polystyrene, polyurethane and polyvinylchloride.

11. The skateboard wheel as recited in claim 10 wherein said injected molded thermoplastic wheel cover rim is metalized.

12. The skateboard wheel as recited in claim 1 wherein said attachment means for securing the wheel cover rim to the tire farther comprises an adhesive.

13. The skateboard wheel as recited in claim 1 wherein said attachment means for securing the wheel cover rim to the tire farther comprises, said tire concentric circular recessed cavity having a circumferential groove therein permitting the rim to snap into the groove therefore retaining the rim by the outward urging of the rim against the groove.

14. The skateboard wheel as recited in claim 1 wherein said attachment means for securing the wheel cover rim to the tire further comprises a plurality of self thread cutting screws and said tire recessed cavity further having a plurality of pilot holes in which the self thread cutting screws are rotatably inserted.

15. The skateboard wheel as recited in claim 1 wherein said attachment means for securing the wheel cover rim to the tire further comprises a plurality of inserts pressed into the recessed cavity in the tire with a plurality of mating machine screws threaded into the inserts.

16. The skateboard wheel as recited in claim 1 wherein said attachment means for securing the wheel cover rim to the tire further comprises, said wheel cover rim having a plurality of integral studs and said tire having pilot holes therein for mating with the studs when the rim is pressed into the recessed cavity with the studs interfacing with the pilot holes in a gripping manner.

17. The skateboard wheel as recited in claim 1 wherein said attachment means for securing the wheel cover rim to the tire further comprises a plurality of male threads integrally formed on an outside diameter of the rim and said tire concentric circular recessed cavity having a mating circumferential groove angled to mate with a same but opposite pitch as the male threads, and said wheel cover rim central opening formed in a hexagonal shape permitting installation and removal with a hexagonal outlined tool.

18. A skateboard wheel, having bearings pressed centrally therein, covered to enhance the appearance of the wheel, comprising:

a tire for a skateboard having an outer side wall, wherein said tire having a recessed cavity within the outer side wall, a wheel cover rim disposed within said recessed cavity, and said wheel cover rim including a decorative design on an exposed surface, and attachment means for securing the wheel cover rim to the tire.

* * * * *